United States Patent [19]

Mattson

[11] 4,053,138

[45] Oct. 11, 1977

[54] METHOD OF LIFTING OR LOWERING AN OBJECT BY MEANS OF A PLURALITY OF SO-CALLED CLIMBING JACKS

[75] Inventor: Arne J. Mattson, Vasteras, Sweden

[73] Assignee. Paul Anderson Industrier AB, Vasteras, Sweden

[21] Appl. No.: 689,630

[22] Filed: May 24, 1976

[30] Foreign Application Priority Data

May 29, 1975 Sweden ..... 7506170

[51] Int. Cl.[2] ..... B66F 1/00

[52] U.S. Cl. ..... 254/105

[58] Field of Search ..... 254/105–111; 52/122, 126

[56] References Cited

U.S. PATENT DOCUMENTS

| | | | |
|---|---|---|---|
| 289,644 | 12/1882 | Goodridge | 52/126 |
| 2,380,692 | 7/1945 | Gunnison | 52/126 |
| 3,065,573 | 11/1962 | Goldberg | 52/126 |
| 3,289,868 | 12/1966 | Miller et al. | 254/45 |
| 3,327,997 | 6/1967 | Zenke | 52/126 |

*Primary Examiner*—Harold D. Whitehead
*Assistant Examiner*—Robert C. Watson
*Attorney, Agent, or Firm*—Sughrue, Rothwell, Mion, Zinn and Macpeak

[57] ABSTRACT

A method of lifting or lowering of an object by means of a plurality of climbing jacks capable to climb each along a climb rod. The method comprises the steps of staying the rods slidably by means of associated support structures, arranging each rod on a jack, which jacks are held separated from each other from a load point of view, and adjusting the height position of the climb rods in relation to each other by means of the respective jack in order to minimize the stresses in the object caused by the lifting operation.

3 Claims, 1 Drawing Figure

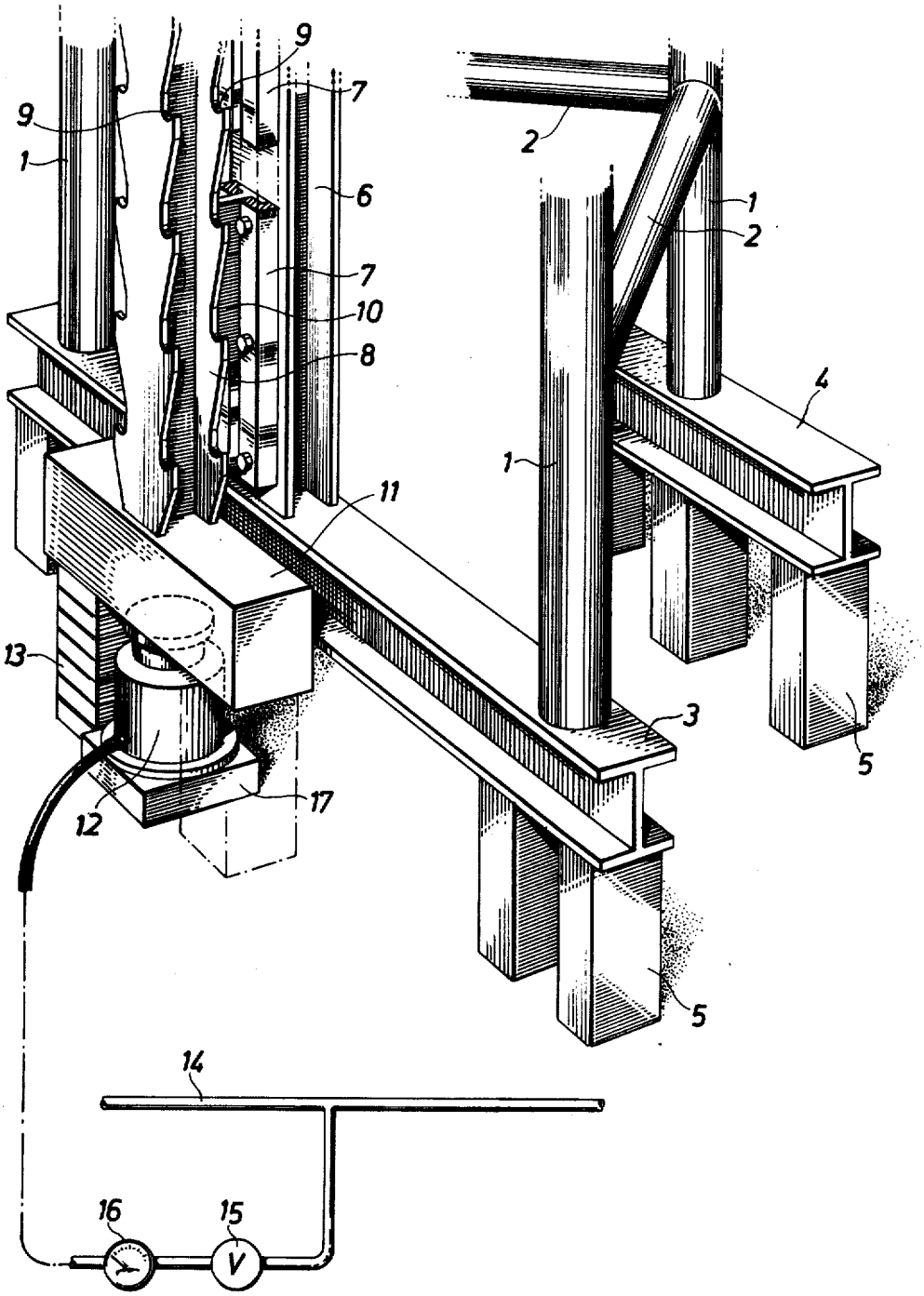
9
9
7
1
6
2
1
2
7
10
8
4
1
11
13
3
5
12
17
5
14
16
15
V

METHOD OF LIFTING OR LOWERING AN OBJECT BY MEANS OF A PLURALITY OF SO-CALLED CLIMBING JACKS

This invention relates to a method of lifting or lowering of an object by means of a plurality of so-called construction or climbing jacks capable to climb each along a climb rod stayed by associated support structures. The invention particularly is intended to minimize the stresses in the object in connection with such lifting operations.

When heavy objects, particularly such with a large extension in the plane, e.g. girders for cranes, are to be lifted to a great height, often so-called climbing jacks are used, i.e., jacks capable of moving by steps in one or the other direction along a rod. In view of the weight and extension of the objects, it is often necessary to use a plurality of jacks for the lifting operations. As in many cases the centre of gravity of the object to be lifted is not known, the work is to be carried out with the approximate position of the gravity centre being assumed. On the basis of such assumptions the points are to be determined in which the lifting forces are to apply, which points during the lifting operation must move at the same rate in order to maintain the object during the lifting operation in unchanged position in the horizontal plane. When this described method is applied, the jacks usually are subjected to different loads which cannot be controlled. This has been regarded as a great disadvantage, and different systems for balancing the load between the different jacks have been proposed. One such system is described in the Swedish patent specification No. 227,084, according to which the climbing jacks at their mounting are positioned each on a balancing device constituting a hydraulic jack. These jacks are interconnected by hydraulic conduits to form communicating hydraulic groups.

By a system of this kind, certainly, the same load is obtained on the different jacks, but it does not bring about the effect of maintaining the object in its position in the horizontal plane during the lifting operation. On the contrary, the object to be lifted will be subjected to additional stresses, because jacks exposed to a heavier load than other jacks will lag behind. These additional stresses arise as a result thereof, that the object proper must transfer moments and shearing forces. The utilization of balancing jacks, therefore, implies risks that the object to be lifted will be damaged.

The aforesaid type of stresses and strains in the object to be lifted also is the result of a certain settling of the foundations, on which the climb rods are supported, when the objects to be lifted are very heavy. This problem exists when the climb rods being used are smooth, but can be reduced by driving one or more jacks separately through a desired distance. The structural difficulties of manufacturing the jacks for smooth climb rods, however, increase with increasing size of the jacks. when climb rods are used which are provided with shoulders where the climbing steps are determined by the distances between the shoulders, it is, however, impossible to make adjustments smaller than one entire climbing step, which in most cases is too great for said purpose.

The main object of the present invention is to provide a method of lifting of heavy objects which minimizes the risks that the object being lifted is subjected to detrimental stresses during the lifting operation.

This object of the invention is achieved thereby that the climb rods are arranged so that they can be moved in the vertical direction and each on a jack, which jacks are held separated from each other from a load point of view. When settlings of the foundations of the climb rods occur, said jacks can be used for adjusting the height position of the respective climb rod in relation to the remaining climb rods.

The said jacks must be dimensioned for the load which the associated climb rod may have to carry. In order to control that the load on a climb rod does not exceed a highest critical value, the hydraulic system of each jack, when hydraulic jacks are used for said height adjustment, preferably is provided with a device rendering possible the connection to a pressure gauge. With knowledge of the piston area in the jack and the oil pressure in question, it is easy to determine the load acting on the climb rod. It is hereby possible at the initiation of a lifting operation to obtain the desired distribution of the load between the different jacks by adjusting their positions of engagement with the object to be lifted. The balancing jacks according to the aforementioned Swedish patent, thus, can be abandoned.

Between each climb rod and the respective adjusting jack preferably a beam is provided which can be utilized for trestling the climb rod in order to relieve the jack.

When a plurality of hydraulically interconnected climbing jacks are used, they per se will act during the working stroke as balancing jacks according to the aforesaid patent. By providing the jacks with end stops stopping the pistons after they have been extended a distance which does not substantially exceed the distance between the shoulders on a climb rod, the rigidness of the object to be lifted normally should be so great as to be sufficient to transfer the load here concerned from the most loaded jacks to the less loaded jacks. With increasing size of the jacks, however, it is more justified to utilize the hydraulic pump for each jack whereby also the problem with the aforementioned balancing due to hydraulically interconnected jacks is eliminated.

The special features characterizing the invention become apparent from the attached claims.

The invention is described in greater detail in the following, with reference to the accompanying drawing showing the lower portion of a climb rod stayed by a supporting mast and positioned on an adjusting jack.

The reference numeral 1 designates the vertical uprights comprised in a triangular stay mast of known lattice-work with transverse struts 2. The uprights 1 rest on beams 3 and 4, which according to the FIGURE are trestled by means of support members 5. It is hereby possible to insert adjusting jacks beneath said beams for correcting the height positions of the beams, if this would be necessary due to settlings in the foundation of the mast.

On one side of the mast a vertical beam 6 is provided, and at the outer surface thereof a longitudinal guide bar 7 for a climb rod 8 is attached. At the embodiment shown the climb rod 8 is an I-beam, the flanges of which are provided with regularly spaced shoulders 9, which co-operate with a jack (not shown) climbing up and, respectively, down along the rod. When climbing jacks of other types are used, the climb rod may also be an entirely smooth rod. Along the climb rod slide shoes 10 are arranged at a certain spaced relationship and co-operate with the guide bar 7, as is apparent from the drawing.

By means of said slide shoes 10 and the guide bar 7 attached to the beam 6, horizontal forces acting on the climb rod 8 are transferred to the stay mast structure 1,2. The connection of the climb rod with the mast, however, permits relative movements between them in vertical direction whereby the vertical forces transferred via the climbing jack to the climb rod 8 are not transferred to the stay mast, but are taken up entirely by the climb rod 8.

The drawing shows only one climb rod, but each stay mast can be provided with several climb rods. As mentioned above, when very heavy objects and/or such with a large extension in the horizontal plane are to be lifted, a plurality of climbing jacks and, thus, also of stay masts are required, which jacks engage with the object in different points. In order to maintain the object in its original position in the horizontal plane, the movements of the different climbing jacks must be synchronized. When climb rods with shoulders 9 are used, it is then necessary that the relative levels for these shoulders are maintained during the lifting operation. It is, however, to be expected that settlings of different type can occur at the foundation below the respective climb rod, as a result of which the initial setting of the different climb rods can get lost during the lifting operation. In such a case the load distribution between the different climbing jacks will be changed and stresses will arise in the object being lifted.

In order to eliminate this problem, according to the invention each climb rod 8 is mounted on a carrying beam 11, which is supported on a hydraulic jack 12, which in the event of settlings occurring in the foundation below the climb rod can be utilized for restoring the height position of the climb rod relative to the other climb rods in the group about the object to be lifted. For relieving the jack 12, the beam 11 can be trestled by means of support members 13 on each side of the jack 12.

The jack 12 can be connected to a pressure oil conduit 14 common to all adjusting jacks via a shut-off valve 15 and a manometer 16. By means of the manometer 16 which senses the oil pressure in the jack 12, the piston area of which is known, the load on the associated climb rod, and therewith on the climbing jack, can be determined in a simple way.

When a heavy object is being lifted by utilizing a plurality of climbing jacks capable to climb along climb rods 8 slidably attached to stay mast structures 1,2, the operation is as follows. The climb rods 8, by utilizing the jacks 12, are so positioned in height that corresponding shoulders 9 of the different climb rods are on the same level or, e.g. due to the shape of the object being lifted, offset in a certain spaced relationship to each other. The climb rods thereafter preferably are provided at their lower portion with an index mark, which for all rods lies on the same height level. In connection with said height setting, preferably a levelling instrument of a type known per se is used. Thereafter the load is relieved from the support by means of the jacks climbing on the rods 8. In connection therewith, settlings can occur at the foundation of one or more climb rods. The size of the settlings is determined by said levelling instrument. Thereafter the original height position for the different climb rods 8 relative to each oter is restored by means of the adjusting jacks 12 beneath the climb rods in order to reduce the stresses in the object being lifted. In connection therewith, also the load on the respective climbing jack can be determined on the basis of the value read on the manometer 15. It is, thus, possible to read already from the beginning how the load is distributed on the different jacks, and measures can be taken when some jack is loaded with too great a load. This implies that no balancing jacks according to the said Swedish patent must be used which, as explained above, can give rise to increased stresses and strains in the object being lifted. At regular intervals during the lifting operation the height position for the climb rods is checked and height adjustments according to above are carried out as soon as they prove necessary. The trestling 13 beneath the carrying beam 11 serves as a safety means, but it also permits that the jack can be relieved and trestled to desired height by means of spacers 17 when the total height adjustment for a climb rod approaches the stroke length of the jack 12.

In order to prevent the climbing jacks from acting as balancing jacks, preferably a separate pump is used for each climbing jack.

The latches of the climbing jacks or the shoulders 9 on the climb rod preferably are provided with sensing means emitting a signal, indicating when the respective jack having made engagement with different shoulders.

The invention, thus, renders it possible among other advantages to maintain the relative levels for the climbing jacks, which is essential in order to avoid incalculable stresses to arise in the object while it is being lifted. A further substantial advantage is that all necessary adjustment work can be carried out on the ground. The jacks 12, which also may be of a kind other than shown, thus act both as height adjusting means and as load sensors. The described height adjustment of the climb rods, of course, is also applicable to smooth climb rods as the aforesaid problems resulting from settlings also arise in connection with such rods.

I claim:

1. A method of lifting or lowering an object on a mast structure by means of a plurality of climbing jacks capable of climbing each along a climb rod, comprising the steps of: mounting the rods to the mast on associated support structures to allow relative movement between the rod and the mast, arranging each rod on a jack associated with each rod, each jack separated from each other from a load point of view, and adjusting the height position of the climb rods in relation to each other by means of a respective associated jack in order to minimize the stresses in the object caused by the lifting operation.

2. A method according to claim 1, wherein hydraulic jacks are used and including the step of utilizing the pressure in the hydraulic system of each jack for checking the size of the load acting on the respective jack.

3. A method according to claim 1, including the step of arranging each climb rod on a beam carried by the associated jack and rendering it possible to relieve the jack by trestling.

* * * * *